US006174495B1

(12) United States Patent
Nishikiori

(10) Patent No.: US 6,174,495 B1
(45) Date of Patent: Jan. 16, 2001

(54) TITANIUM ALUMINIDE FOR PRECISION CASTING

(75) Inventor: Sadao Nishikiori, Hoya (JP)

(73) Assignee: Ishikawajima-Harima Heavy Industries Co., Ltd., Tokyo (JP)

( * ) Notice: Under 35 U.S.C. 154(b), the term of this patent shall be extended for 0 days.

(21) Appl. No.: 09/271,422

(22) Filed: Mar. 16, 1999

(30) Foreign Application Priority Data

Mar. 25, 1998 (JP) ..... 10-095172

(51) Int. Cl.[7] ..... C22C 14/00; C22F 1/18
(52) U.S. Cl. ..... 420/420; 148/421; 148/669
(58) Field of Search ..... 420/420, 418; 148/421, 669

(56) References Cited

FOREIGN PATENT DOCUMENTS

| | | | |
|---|---|---|---|
| 469525 | 7/1991 | (EP) | C22C/14/00 |
| 620287 | 7/1991 | (EP) | C22C/14/00 |
| 560070 | 2/1993 | (EP) | C22C/14/00 |
| 7-18392 | 1/1995 | (JP) | C22F/1/18 |
| 8-311585 | 11/1996 | (JP) | C22C/14/00 |

*Primary Examiner*—Deborah Yee
(74) *Attorney, Agent, or Firm*—McCormick, Paulding & Huber LLP

(57) ABSTRACT

Titanium aluminide for precision casting, having the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities. A melt of this titanium aluminide is powered into a die and cooled at a general speed. A cast will have a fully lamellar structure almost entirely in an as-cast condition. This titanium aluminide does not have precipitation of $\beta_2$ phase in a colony grain boundary of the lamellar structure. It is therefore possible to obtain a higher degree of grain boundary serration in the as-cast condition. As a result, the titanium aluminide product has an excellent creep property.

16 Claims, 5 Drawing Sheets

TITANIUM ALUMINIDE FOR PRECISION CASTING

BACKGROUND OF THE INVENTION

1. Field of the Invention

The present invention generally relates to titanium aluminide for precision casting, and more particularly to titanium aluminide which is not heat treated after a precision casting process but results in a cast with high creep strength.

2. Description of the Related Art

Titanium aluminide (TiAl alloy) possesses various advantages such as being lightweight, demonstrating satisfactory strength at elevated temperature and having decent rigidity. Therefore, the titanium aluminide is considered as a new favorable material for rotating parts of an aircraft engine and vehicle engine or the like, and there is an increasing tendency to put it to practical use.

Conventionally, as taught for example in Japanese Patent Application Laid-Open Publication No. 8-311585, Fe and/or V is added to TiAl alloy as a third element to improve castability and B is added to TiAl alloy to provide fine crystal grains. By adding these third elements, it has become possible to fabricate a complicated product by precision casting. It is also known from the above mentioned Japanese publication that TiAl alloy having improved room temperature ductility and/or processability is obtainable by optimizing heat treatment. TiAl alloy disclosed in this Japanese publication is referred to as the conventional TiAl alloy or titanium aluminide according to the prior art hereinafter.

However, studies of TiAl alloys are primarily focused on improvements of room temperature ductility so that developed TiAl alloys have relatively low creep strength. Particularly, satisfactory creep strength is not demonstrated beyond 700° C.

In order to raise the creep strength of TiAl alloys, there is known a method of adding a third element (Mo, Cr, W, Nb, Ta, etc.) into a TiAl mother alloy. This method, however, considerably degrades the precision castability of TiAl alloy so that a product with a complicated shape cannot be fabricated.

To overcome the above problems, the inventor proposed a novel TiAl alloy and casting method using the same in a copending U.S. patent application Ser. No. 09/217,673, entitled "TITANIUM ALUMINIDE FOR PRECISION CASTING AND METHOD OF CASTING USING TITANIUM ALUMINIDE" filed Dec. 21, 1998. The entire disclosure thereof is incorporated herein by reference and this TiAl alloy is referred to as TiAl alloy or titanium aluminide of earlier invention. The inventor disclosed how to heat treat the TiAl alloy in order to have a desired (or controlled) structure. The creep characteristic and precision castability are both improved according to this teaching. In particular, the improved creep strength demonstrates a value ten times (or more) greater than the conventional TiAl alloy without deteriorating the precision castability.

However, this TiAl alloy includes a trace amount of β phase precipitated in the structure in an as-cast condition. The β phase has an adverse effect on the room temperature tensile strength so that a particular heat treatment is required to disperse the β phase. This raises the manufacturing cost. If this TiAl alloy is used to fabricate rotating parts of an aircraft engine which are not generally manufactured on a mass production basis, the resulting products are satisfactory both in terms of mechanical property and cost, but if it is used as a material for rotating parts of an automobile engine which are manufactured on a mass production basis, the products have desired mechanical characteristics but entail a high manufacturing cost.

SUMMARY OF THE INVENTION

One object of the present invention is to provide titanium aluminide for precision casting which can eliminate the above described problems of the prior art and earlier invention. Specifically, the present invention intends to provide titanium aluminide for precision casting which has decent creep strength, castability and manufacturing cost.

According to one aspect of the present invention, there is provided titanium aluminide for precision casting, having the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities. If a melt of this titanium aluminide is poured into a die and cooled at a general speed (15–150° C./sec, preferably 30–100° C./sec), a product (cast) will have a fully lamellar structure almost entirely in an as-cast condition. This titanium aluminide does not have precipitation of β phase in a colony grain boundary of the lamellar structure. It is therefore possible to obtain a higher degree of grain boundary serration in the as-cast condition. As a result, the titanium aluminide product has an excellent creep property. The titanium aluminide may be used as a material for a rotor of a turbocharger which is a rotating part of an automobile engine. The die may have a complicated shape for precision casting.

According to another aspect of the present invention, there is provided a method of casting comprising:

providing a melt of titanium aluminide which possesses the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities;

pouring the titanium aluminide melt into a mold; and cooling the titanium aluminide melt to obtain a cast.

The cast (product) has a higher degree of grain boundary serration even in the as-cast condition and therefore demonstrates improved creep strength. This method does not include any heat treatment steps to control a structure of the alloy. The mold may have a complicated shape for precision casting. The cast may be a turbocharger rotor for an automobile engine.

DETAILED DESCRIPTION OF THE INVENTION

Now an embodiment of the present invention will be described in reference to the drawings.

The inventor diligently studied TiAl alloy to have sufficient castability and creep strength in an as-cast condition, i.e., without performing heat treatment for the purpose of structure control, and found the following facts:

1) In order to omit the heat treatment, almost all of the structure of TiAl alloy has to have a fully lamellar structure in the as-cast condition. To this end, an amount of Al to be added is reduced as compared with the TiAl alloy of earlier invention.

Figure 1:
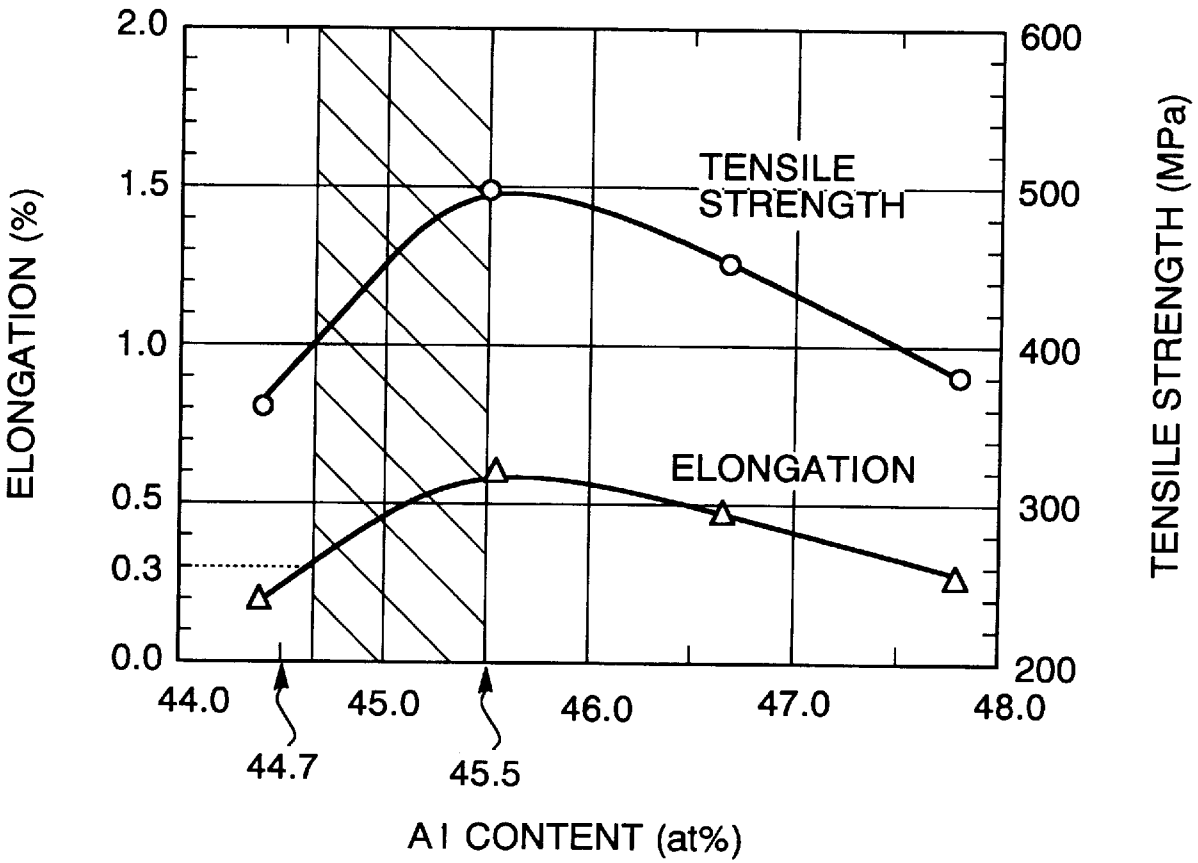
FIG. 1 illustrates relationship among an Al content, room temperature tensile strength and elongation.

Referring to FIG. 1, illustrated is the relationship between the Al content and room temperature tensile strength characteristics. In this diagram, the unshaded circle indicates the tensile strength (MPa) and the unshadedi triangle indicates elongation (%).

As understood from FIG. 1, the tensile strength characteristic curves (tensile strength and elongation) have peak points (tensile strength is 500 MPa and elongation is 0.6%) when the Al content is 45.5 at %, as the amount of Al to be added is reduced, and steeply drop after the peaks. When the elongation becomes lower than 0.30%, it is difficult for factory workers or engineers to handle this material. The Al content is preferred to be around 45.5 at %. This is a first point to be considered.

Figure 2:
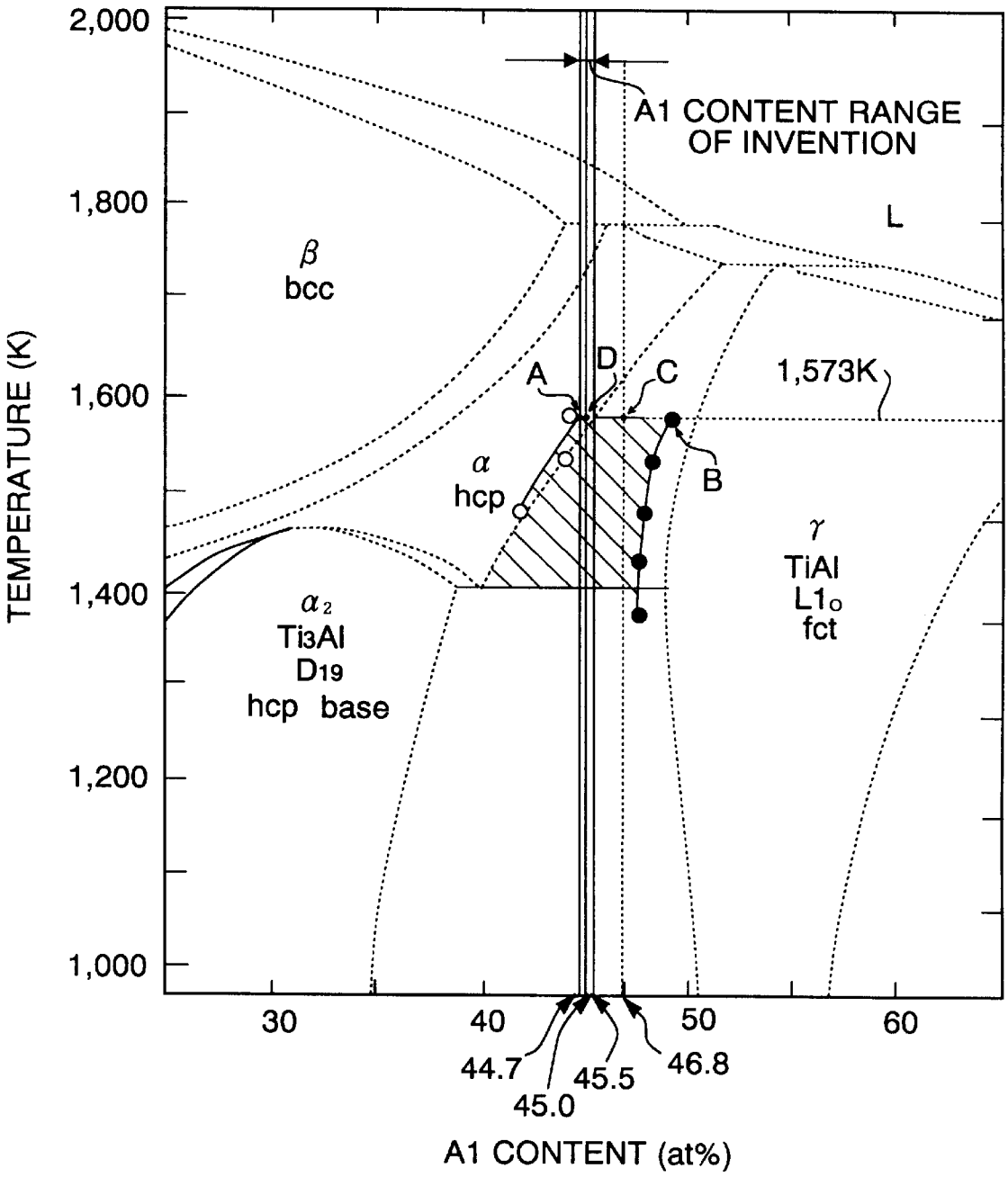
FIG. 2 is a binary phase diagram of titanium aluminide.

Referring to FIG. 2, illustrated is a binary phase diagram of titanium aluminide. The horizontal axis indicates the Al content (at %) and the vertical axis indicates temperature (K). In this diagram, the three vertical solid lines extending from an Al content of about 45.0 at % (about 31.5 wt %) indicate the titanium aluminide for precision casting according to the present invention and the single broken line extending from an Al content of about 46.8 at % (about 33.1 wt %) indicates the titanium aluminide for precision casting according to the prior art. The unshaded circle indicates an amount of actual Al component of the $\alpha$ phase in the conventional TiAl at various temperature and the shaded circle indicates the actual Al component of the $\gamma$ phase.

As seen in FIG. 2, if TiAl alloy cooling is performed to slowly pass the oblique line area (hatching area at the center of FIG. 2), the granular $\gamma$ phase is precipitated and therefore the lamellar structure or phase is restrained. Consequently, it is necessary that the TiAl alloy is rapidly cooled and passes the oblique line area as fast as possible. In order to have a steep temperature inclination during cooling, the point D should be shifted up to an elevated temperature value. This is the second point to be considered.

In addition, the point D should be shifted to have a less Al content in order for the TiAl alloy to have the lamellar structure entirely. This is the third point to be considered. In the present invention, the amount of Al to be added into the TiAl mother alloy is reduced as compared with the conventional TiAl material. Therefore, the amount ratio of the $\alpha_2$ phase and $\gamma$ phase ($\alpha_2/\gamma$) at about 1,570 K is controlled to DB/DA in the invention whereas the same is CB/CA in the conventional TiAl material, according to "the action of levers" in the binary phase diagram. As a result, the amount of $\gamma$ phase itself precipitated in the TiAl matrix is considerably reduced.

In consideration of the above three points in the best compromised way, the Al content is determined to be 44.7 to 45.5 at % (31.3 to 32.0 wt %) in the invention.

2) In order to maintain satisfactory castability, Fe and V are added as the third elements. However, the amount of Fe and V to be added is reduced as compared with the TiAl of earlier invention to suppress precipitation of the $\beta$ phase.

3) In order to have complete grain boundary serration in the as-cast condition, it is preferred to prevent the $\beta$ phase from precipitating in the colony grain boundary of the lamellar structure. The $\beta$ phase deteriorates the mechanical characteristics of the material, particularly room temperature tensile strength.

Figure 3:
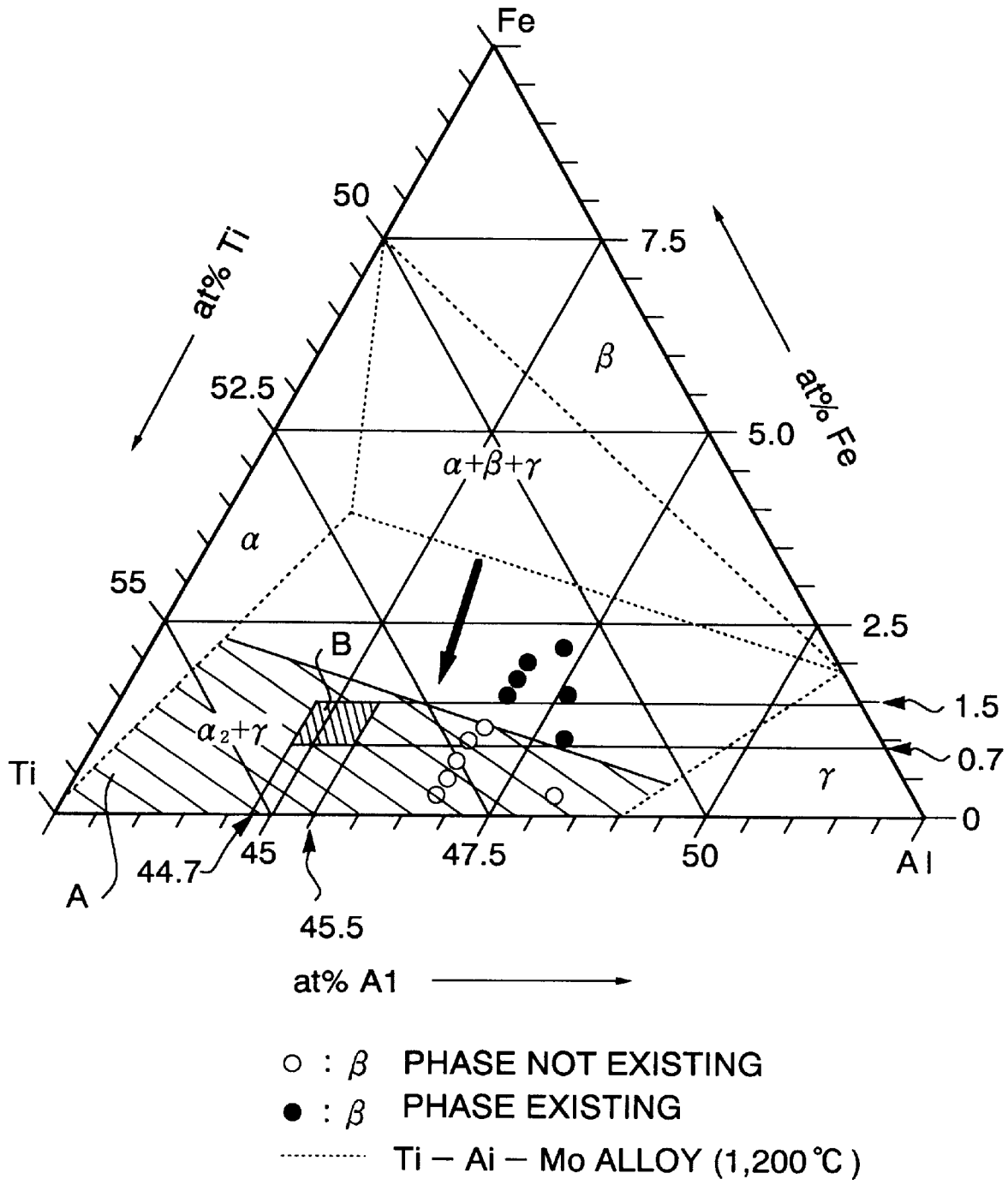
FIG. 3 illustrates a ternary phase diagram of Ti—Al—Fe alloy.

FIG. 3 illustrates the Ti—Al—Fe ternary phase diagram at 1,200° C. after being maintained for two hours (1,200° C. and two-hour heat treatment). For comparison, the Ti—Al—Mo phase diagram is also depicted in FIG. 3 by the broken line. The Ti—Al—Fe alloy has the ($\alpha(_2)+\gamma+\beta$) three-phase region and/or the ($\alpha_2+\gamma$) two-phase region due to the change of Fe amount between about 0.2 at % and 2.3 at % when the amount of Al is limited to about 46.7 at % to 48.3 at %. The same thing can be said to the ternary Ti—Al—Mo alloy. There exists the phase boundary between the ($\alpha+\gamma+\beta$) three-phase region (shaded circle) and the ($\alpha+\gamma$) two-phase region (unshaded circle).

As understood from FIG. 3, the precipitation of $\beta$ phase in the Ti—Al—Fe alloy greatly depends upon the amount of Fe added, and the area having no $\beta$ phase ($\alpha_2$ area+$\gamma$ area) is indicated by the oblique line area A. This observation reveals that the amount of Fe to be added is preferably reduced as small as possible. In consideration of the above 2), the amount of Fe to be added is determined to be between 0.7 at % (0.5 wt %) and 1.5 at % (1.0 wt %). The lower limit of 0.7 at % is a value below which casting becomes impossible, and the upper limit of 1.5 at % is a value over which desired mechanical characteristics are not obtained.

As the result of the above analysis 1) to 3), the titanium aluminide for precision casting according to the present invention should have the chemical composition within a range indicated by the quadrilateral B in FIG. 3.

4) In order to have coarser crystal grains in the as-cast condition, the amount of B to be added is reduced as compared with the TiAl alloy of the earlier invention.

From the above analysis 1) to 4), the titanium aluminide for precision casting according to the invention has the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities. If cast, a product made of this titanium aluminide has a lamellar structure almost entirely in the as-cast condition.

Now, a precision casting method using the above described titanium aluminide will be described.

By adjusting the amounts of various elements added, a melt of TiAl mother alloy is prepared. The resulting TiAl melt has the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities.

This TiAl melt is then poured into a die and cooled. The die may have a complicated shape so that a precision cast results. The lamellar structure precipitates almost entirely across the structure of TiAl alloy in the as-cast condition. The melt is generally cooled by, for example, air cooling at a common rate (15–150° C./sec, preferably 30–100° C./sec), but may be cooled faster (100–300° C./sec) if necessary.

Since the amounts of elements included in the TiAl mother alloy (melt) are adjusted to have particular values in the predetermined ranges respectively before poured into the die, the lamellar structure is precipitated almost entirely in the crystal grains and the granular γ phase is hardly precipitated. Further, no β phase is precipitated in the colony grain boundary of the lamellar structure so that a higher degree of grain boundary serration is obtained in the as-cast condition. Accordingly, the cast possesses excellent creep property without heat treatment.

Since the TiAl alloy having excellent creep property is obtainable without heat treatment, the manufacturing cost for TiAl alloy can be reduced. This in turn results in cost reduction of the products. Therefore, it is now possible to use the TiAl alloy for rotating members of an automobile engine (particularly, parts of a turbocharger loaded on a truck) which are fabricated on a mass production basis. Conventionally, the manufacturing cost is too high to use this material for the vehicle's turbocharger parts.

EXAMPLES

Figure 4A:
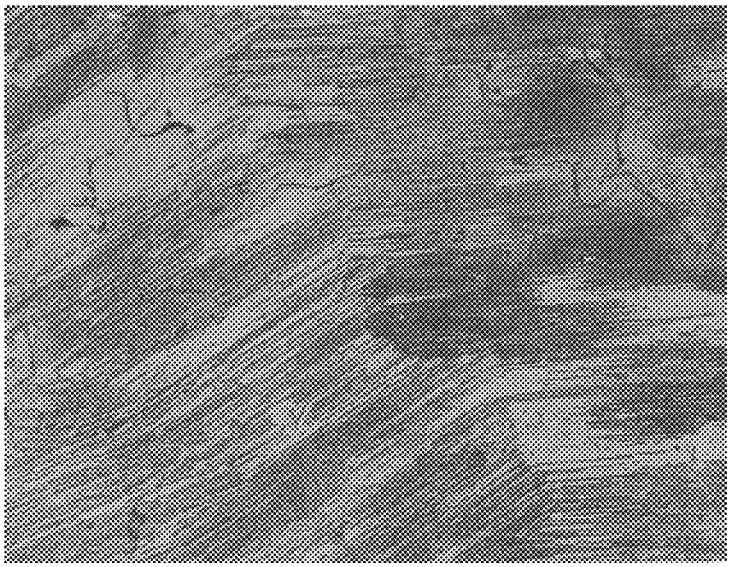
FIG. 4A is a copy of photograph showing a structure of titanium aluminide according to the present invention.
Figure 4B:
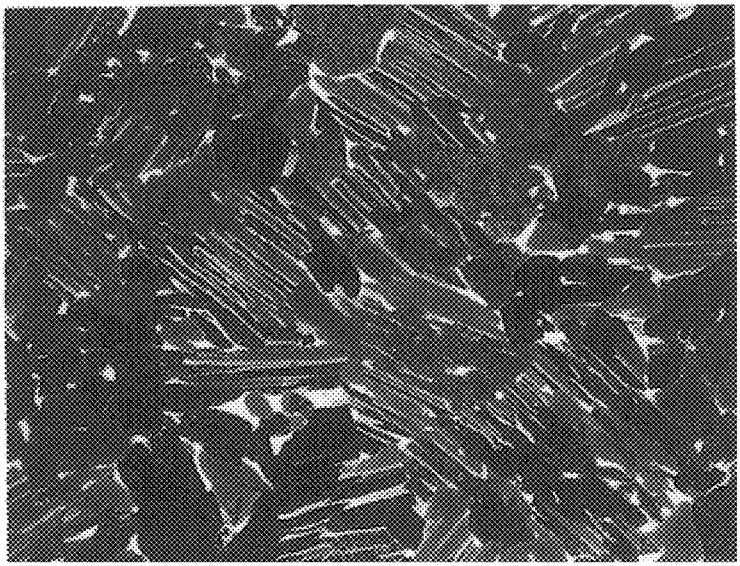
FIG. 4B PRIOR ART
FIG. 4B is a copy of photograph showing a structure of titanium aluminide according to the prior art.

Referring to FIGS. 4A and 4B, presented are copies of photograph showing structures of titanium aluminide for precision casting according to the present invention and the prior art respectively. Specifically, FIG. 4A is an EPMA photograph (×200) of the invention titanium aluminide and FIG. 4B is a similar photograph (×200) of the conventional titanium aluminide.

In FIG. 4B, thick line-like $\alpha_2$ phase ($Ti_3Al$) is precipitated in the crystal grain (white thick lines in the drawing). Further, the granular γ phase is seen in a localized manner (black particles). Moreover, crystal grain boundary serrations are hardly obtained in the as-cast condition, and equi-axed crystals are present.

In FIG. 4A, on the contrary, the lamellar structure ($\alpha_2+\gamma$) is precipitated almost entirely in the crystal grain of the invention titanium aluminide. Further, precipitation of granular $\gamma_2$ phase is not seen. Moreover, the β phase is not precipitated in the colony crystal grain boundary of the lamellar structure. In addition, the crystal grain boundary serration is obtained in a higher degree in the as-cast condition so that crystal grains engage with each other in a complicated manner like saw teeth.

Figure 5:
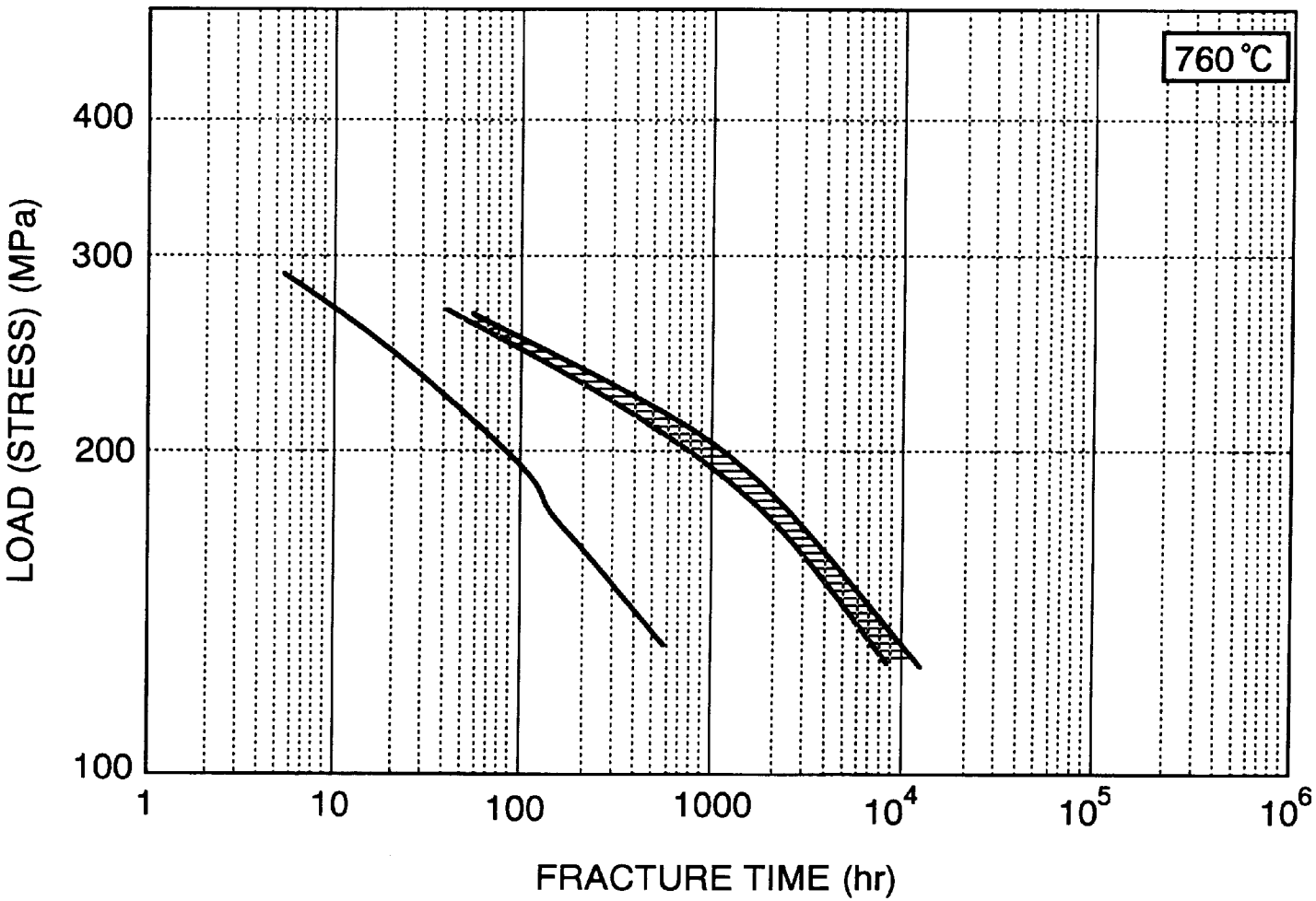
FIG. 5 illustrates creep characteristics of the titanium aluminide according to the present invention and prior art.

Referring to FIG. 5, illustrated is a creep characteristics of the titanium aluminide of the invention and the prior art. The horizontal axis indicates a time for fracture (hr) and the vertical axis indicates an applied stress (MPa). The hatched area indicates the creep strength of the invention titanium aluminide. The single solid line curve on the left of the hatched area indicates the conventional TiAl alloy. The creep test was conducted under a high temperature (760° C.).

As understood from FIG. 5, a time needed until fracture of the invention titanium aluminide of the as-cast condition is about ten times longer than the conventional titanium aluminide if the same stress is applied.

FIG. 5 proves that the obtained TiAl alloy has sufficient creep strength even in the as-cast condition by having the lamellar structure precipitated almost entirely in the crystal grains and a higher degree of grain boundary serration in the as-cast condition.

The titanium aluminide according to the present invention is particularly suited for precision casting. For example, it is used as a material for rotating parts (e.g., blades) and stationary parts (e.g., vanes and rear flaps) of an aircraft engine and for rotating parts of an automobile engine (e.g., turbocharger rotors).

The above described titanium aluminide and casting method are disclosed in Japanese Patent Application No. 10-95172 filed Mar. 25, 1998 with JPO, and the entire disclosure thereof is incorporated herein by reference. The subject application claims priority of this Japanese Patent Application.

What is claimed is:

1. A titanium aluminide for precision casting, having the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities.

2. The titanium aluminide for precision casting of claim 1 used as a rotating part of an automobile engine.

3. The titanium aluminide for precision casting of claim 1 used as a rotating part of an aircraft engine.

4. An article of manufacture made by casting, the article of manufacture having the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities, and having a fully lamellar structure almost entirely in an as-cast condition.

5. The article of manufacture of claim 4 used as a rotating part of an automobile engine.

6. The article of manufacture of claim 4 used as a rotating part of an aircraft engine.

7. A method of casting comprising:

preparing a melt of titanium aluminide which possesses the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities;

pouring the titanium aluminide melt into a mold; and cooling the titanium aluminide melt to obtain a cast.

8. The method of casting of claim 7, wherein the mold has a complicated shape for precision casting.

9. The method of casting of claim 7, wherein the method does not include any heat treatment.

10. The method of casting of claim 7, wherein the titanium aluminide is cooled at a rate between 15° C./sec and 150° C./sec.

11. The method of casting of claim 7, wherein the titanium aluminide is cooled at a rate between 30° C./sec and 100° C./sec.

12. A method comprising:

providing a melt of titanium aluminide which possesses the following chemical composition:

Al: 31.3 to 32.0 wt %,

Fe: 0.5 to 1.0 wt %,

V: 1.0 to 1.5 wt %, and

B: 0.03 to 0.06 wt %, with the remainder being Ti and inevitable impurities;

pouring the titanium aluminide melt into a mold; and cooling the titanium aluminide melt to obtain a cast in such a manner that a lamellar structure is precipitated almost entirely in a crystal grain and a higher degree of serration is obtained in a crystal grain boundary in an as-cast condition.

13. The method of claim 12, wherein the mold has a complicated shape for precision casting.

14. The method of casting of claim 12, wherein the method does not include any heat treatment.

15. The method of casting of claim 12, wherein the titanium aluminide is cooled at a rate between 15° C./sec and 150° C./sec.

16. The method of casting of claim 12, wherein the titanium aluminide is cooled at a rate between 30° C./sec and 100° C./sec.

* * * * *